US007717746B2

(12) United States Patent
Nagai et al.

(10) Patent No.: US 7,717,746 B2
(45) Date of Patent: May 18, 2010

(54) BULB SOCKET STRUCTURE FOR ONBOARD INTERIOR LIGHTING SYSTEM

(75) Inventors: Kentaro Nagai, Shizuoka-ken (JP); Yasuo Suzuki, Shizuoka-ken (JP); Ryohei Ochiai, Shizuoka-ken (JP)

(73) Assignee: Yazaki Corporation (JP)

( * ) Notice: Subject to any disclaimer, the term of this patent is extended or adjusted under 35 U.S.C. 154(b) by 0 days.

(21) Appl. No.: 12/353,572

(22) Filed: Jan. 14, 2009

(65) Prior Publication Data

US 2009/0191766 A1 Jul. 30, 2009

(30) Foreign Application Priority Data

Jan. 24, 2008 (JP) ..... P2008-013926

(51) Int. Cl.
*H01R 17/00* (2006.01)

(52) U.S. Cl. ..... 439/619; 439/699.2; 439/375

(58) Field of Classification Search ..... 439/619, 439/699.2, 375
See application file for complete search history.

(56) References Cited

U.S. PATENT DOCUMENTS 5,035,643 A * 7/1991 Forish et al. ..... 439/358
5,509,828 A * 4/1996 Muta et al. ..... 439/699.2
5,709,571 A * 1/1998 Briski et al. ..... 439/699.2
6,022,241 A * 2/2000 Lin ..... 439/419
7,153,171 B1 * 12/2006 Goto ..... 439/699.2

FOREIGN PATENT DOCUMENTS

JP 7-254466 10/1995
JP 2007-245795 9/2007

* cited by examiner

*Primary Examiner*—Gary F. Paumen
(74) *Attorney, Agent, or Firm*—Finnegan, Henderson, Farabow, Garrett & Dunner, L.L.P.

(57) ABSTRACT

Disclosed is a bulb socket structure for an onboard interior lighting system, in which: a bulb attachment hole 12 to which a wedge base bulb 21 is attached is formed in a resin-made housing 10 constituting the onboard interior lighting system; and power supply terminals 15 configured to contact, and conduct electricity to, terminals of a base 21*b* arranged under a bulb part 21*a* of the wedge base bulb when the base is inserted into the inside of the bulb attachment hole are provided in the inside of the bulb attachment hole. In the bulb socket structure, a spacer 30 is provided to the bulb attachment hole 12. The spacer is includes a supporting cylindrical part 31 capable of supporting the bulb part 21*a* of the wedge base bulb from its outer periphery. The spacer is capable of causing the power supply terminals 15 to contact the respective terminals of the base part while protecting the power supply terminals. Guiding slopes 35 configured to guide the base 21*b* to a right position in the inside of the bulb attachment hole 12 while the base is being inserted to the bulb attachment hole are provided to the inside of the supporting cylindrical part.

10 Claims, 9 Drawing Sheets

BULB SOCKET STRUCTURE FOR ONBOARD INTERIOR LIGHTING SYSTEM

BACKGROUND OF THE INVENTION

1. Field of the Invention

The present invention relates to a bulb socket structure for an onboard interior lighting system provided to a ceiling of a vehicle.

2. Description of the Related Art

FIG. 1 is an exploded, perspective view showing a conventional model of bulb socket structure disclosed in Japanese Patent Application Laid-Open No. Hei. 7-254466 (Patent Document 1). FIG. 2 is a front view of a chief section of the conventional model of bulb socket structure. This conventional model of bulb socket structure is of a type to which a wedge base bulb 120 is attached. This model of bulb socket structure includes: a resin-made socket main body 100 (equivalent to a housing); and paired power supply terminals 110, 110 fixed to the inside of a bulb attachment hole 101 of the socket main body 100. This bulb socket structure enables a base 122 of the wedge base bulb 120 to be attached to the paired power supply terminals 110, 110.

Each power supply terminal 110 includes: a base plate 111 fitted into a fitting groove 102 of the socket main body 100; paired holding pieces 112, 112 folded upright from the base plate 111; and paired restricting protrusions 113, 113 folded upright from the base plate 111. The proximal end sides of the respective paired holding pieces 112, 112 are fixed to the base plate 111. The distal end sides of the paired holding pieces 112, 112 are free ends, respectively. A portion between the proximal end and the free end of one holding piece 112 and a portion between the proximal end and the free end of the other holding piece 112 are both bent inward in such a way as to come closer to each other. The restricting protrusions 113, 113 restrict excessive deformations of the holding pieces 112, 112, respectively.

The wedge base bulb (hereinafter referred to as a "bulb") 120 includes: a bulb part 121 having a filament housed therein; and the base 122 which is flat in shape, and which is formed integrally with the bulb part 121 at the lower portion of the bulb part 121. Concave parts 123 are symmetrically formed in the base 122. When the inward-bent portions of the paired holding pieces 112, 112 of each power supply terminal 110 engage with the concave parts 123, electricity is conducted between the terminals of the base 122 and the power supply terminals 110, 110 through their contacts. In addition, a columnar part 124 is provided in the center portion of the base 122 in its width direction.

When the bulb 120 is attached to this bulb socket structure, the bulb 120 is inserted into the bulb attachment hole 101 in the socket main body 100 with the base 122 facing the bulb attachment hole 101. Once the bulb 120 is inserted in the bulb attachment hole 101, the extremity of the base 122 abuts onto the inner surfaces of the distal ends of the paired holding pieces 112, 112 of each power supply terminal 110, respectively. When the bulb 120 is inserted further into the bulb attachment hole 101 from this position, the free end sides of the paired holding pieces 112, 112 deform in directions in which the free ends of the paired holding pieces 112, 112 are separated away from each other. This deformation allows the base 122 of the bulb 120 to be inserted into the interstice between the paired holding pieces 112, 112 beyond the inward-bent portions of the paired holding pieces 112, 112. When the base 122 of the bulb 120 is inserted to a location sufficiently deep so that the concave parts 123, 123 of the base 122 reach the inward-bent portions of the holding pieces 112, 112, the holding pieces 112, 112 return to their initial positions while deforming in directions in which the holding pieces 112, 112 thereof come closer to each other. Thus, the inward-bent portion of each holding piece 112 is fitted into and engaged with its corresponding concave part 123 of the base 122. Thereby, the bulb 120 finishes being attached to the bulb socket structure, and the base 122 of the bulb 120 is held by the paired holding pieces 112, 112 of each power supply terminal 110 with their forces produced due to return from the deformation.

An onboard interior lighting system disclosed in another issue of Japanese Patent Gazette which carries Japanese Patent Application Laid-Open No. 2007-245795 (Patent Document 2) has been known as a conventional model of lighting system using a wedge base bulb as a light source. This onboard interior lighting system has a functional section which is provided on the exterior side of a ceiling board of a vehicle. A bulb socket structure to which a bulb is designed to be attached diagonally is provided to a resin-made housing constituting the main body of the functional section.

In the case of the bulb socket structures described in each patent document, it is likely that the base of the bulb may collide against the power supply terminals in the bulb attachment hole when the wedge base bulb is inserted into the bulb attachment hole, and that the power supply terminals may be accordingly deformed. In particular in the case of the bulb socket structure for the lighting system disclosed in Patent Document 2, since the bulb is designed to be attached to the bulb socket structure obliquely to the functional section main body, the power supply terminals tend to be deformed by the base if the wedge base bulb is inserted into the bulb attachment hole at a wrong angle.

In the case of each conventional model of bulb socket structure, the bulb is designed to be held by the holding pieces of each power supply terminal with their spring forces (forces produced due to return from deformation) only. For this reason, after the bulb is inserted into and detached from the holding pieces of each power supply terminal repeatedly, the spring forces of the holding pieces of each power supply terminal decrease, and the holding forces of the holding pieces thereof accordingly reduces. As a result, the bulb tends to be loose and shaky in the holding pieces thereof. Once the bulb becomes loose and shaky in the holding pieces thereof, the bulb contacts the power supply terminals 110 in a wrong condition, and the shake of the bulb causes abnormal noises. These are problems with the conventional model of bulb socket structure.

SUMMARY OF THE INVENTION

The present invention has been made with the foregoing conditions taken into consideration. For this reason, an object of the present invention is to provide a bulb socket structure for an onboard interior lighting system which allows a bulb to be attached to its power supply terminals smoothly with no power supply terminals being deformed inadvertently, as well as which is capable of preventing the bulb from being in a wrong contact with the power supply terminal, and from causing abnormal noises, due to its loose and shaky contact condition.

For the purpose of achieving the above-described object, a first aspect of the present invention is a bulb socket structure for an onboard interior lighting system, which includes: a resin-made housing constituting the onboard interior lighting system; a bulb attachment hole formed in the housing, the bulb attachment hole being that to which a wedge base bulb is attached; power supply terminals configured to contact, and conduct electricity to, terminals of a base arranged under a bulb part of the wedge base bulb when the base is inserted into the inside of the bulb attachment hole, the power supply terminals being provided in the inside of the bulb attachment hole; and a spacer configured to be attached to the bulb attachment hole, the spacer including a supporting cylindrical part capable of supporting the bulb part of the wedge base bulb from its outer periphery, and the spacer being capable of causing the terminals of the base of the wedge base bulb to contact the respective power supply terminals while protecting the power supply terminals.

The first aspect of the present invention is capable of avoiding deformation of the power supply terminals which would otherwise occur due to inadvertent collision of the base of the wedge base bulb (hereinafter referred to as a "bulb") against the power supply terminals when the bulb is inserted into the bulb attachment hole. That is because the first aspect of the present invention is capable of causing the spacer to protect the power supply terminals provided in the inside of the bulb attachment hole. In addition, the first aspect of the present invention is capable of checking the bulb from being loose and shaky in all the directions, of preventing the power supply terminals from contacting the terminals of the bulb in a wrong condition, and accordingly of enhancing the reliability, even if an external force is applied to the bulb. That is because the first aspect of the present invention causes the supporting cylindrical part of the spacer to support the bulb part of the bulb from its outer periphery while the bulb is being attached to the bulb attachment hole. Furthermore, the first aspect of the present invention makes the housing not to require any extra element which has a function for protecting the power supply terminals from a forced deformation, thereby avoiding the housing having a complicated configuration. That is because the first aspect of the present invention causes the spacer produced independently of the housing to be attached to the housing, and accordingly because the first aspect thereof is capable of preventing the forced deformation of the power supply terminals which would otherwise occur.

A second aspect dependent on the first aspect of the present invention is the bulb socket structure for the onboard interior lighting system according to the first aspect, in which the spacer is detachably attached to the inside of the bulb attachment hole, and in which fixing means configured to lock the spacer when the spacer is attached to the inside of the bulb attachment hole is provided to both the spacer and the housing.

The second aspect of the present invention makes it possible to replace one spacer with another freely. That is because the second aspect of the present invention causes the spacer to be detachably attached to the housing.

A third aspect dependent on the first aspect of the present invention is the bulb socket structure for the onboard interior lighting system according to the first aspect, in which a guiding slope is provided in the inside of the supporting cylindrical part, the guiding slope being configured to guide the base of the wedge base bulb to a right position in the inside of the bulb attachment hole along with the insertion of the base of the wedge base bulb into the inside of the supporting cylindrical part.

The third aspect of the present invention is capable of enhancing the bulb attachment performance. That is because the third aspect of the present invention causes the guiding slope configured to guide the base of the bulb into the right position to be provided in the inside of the supporting cylindrical part of the spacer.

A fourth aspect dependent on the first aspect of the present invention is the bulb socket structure for the onboard interior lighting system according to the first aspect, in which: as the power supply terminal, two power supply terminals each including paired holding pieces configured to hold the base of the bulb between the paired holding pieces are provided; an insertion groove into which to insert the base of the bulb is formed in the spacer; paired guiding slopes are provided in such a way as to be opposed to each other with the insertion groove interposed in between, and in order to guide the base to the insertion groove; and bent parts convex inward of the respective paired holding pieces of each power supply terminal protrude into the insertion groove.

The fourth aspect of the present invention is capable of holding the bulb in a way that the bulb is not loose or shaky, and thus of securely causing the power supply terminals to contact, and conduct electricity to, the respective terminals of the base. That is because the fourth aspect of the present invention causes the paired holding pieces of each power supply terminal to hold the base of the bulb between the paired holding pieces. In addition, the fourth aspect of the present invention is capable of causing the guiding slopes to guide the base of the bulb to the insertion groove without force, and of causing the base to be held between the bent parts of the paired holding pieces of each power supply terminal which bent parts protrude into the insertion groove once the base is inserted into the insertion groove. That is because the fourth aspect of the present invention causes the insertion groove to be formed in an interstice between the paired guiding slopes. Particularly in a case where the base is inserted into the insertion groove in a way that the base is directed at an angle, or even in a case where the insertion groove and the base are not positioned to each other correctly, the fourth aspect thereof is capable of causing the base to be guided to the insertion groove while correcting the orientation of the base through the guiding function of the guiding slopes. For this reason, the fourth aspect thereof is capable of smoothly attaching the base of the bulb to the interstice between the holding pieces of each power supply terminal, and accordingly capable of securely conducting electricity between the terminals of the base and the respective power supply terminals, even if the bulb is inserted therein by touch.

A fifth aspect dependent on the fourth aspect of the present invention is the bulb socket structure for the onboard interior lighting system according to the fourth aspect, in which a columnar hole part into which to insert a columnar part located in a center portion of the base of the bulb in the width direction of the base is provided in a center portion of the insertion groove in its width direction, and in which arcuate walls continuous with the lower ends of the guiding slopes are provided in the periphery of the columnar hole part, respectively.

The fifth aspect of the present invention is capable of causing the base of the bulb to be inserted in the interstice between the holding pieces of each power supply terminal with the base thereof being securely positioned thereto in the width direction. That is because the fifth aspect of the present invention causes the columnar hole part into which to insert the column-shape part located in the center portion of the base in its width direction to be provided in the center portion of the insertion groove in its width direction, and concurrently causes the arcuate walls continuous with the lower ends of the guiding slopes to be provided in the periphery of the columnar hole part, respectively.

A 6th aspect dependent on the fourth aspect of the present invention is the bulb socket structure for the onboard interior lighting system according to the fourth aspect, in which the direction in which the axis of the bulb extends to the housing tilts to a base surface of the housing, and in which the paired guiding slopes are arranged on the upper and lower sides in a direction in which the axis of the bulb tilts, respectively.

The 6th aspect of the present invention is capable of causing the upper and lower guiding slopes to guide the base of the bulb to the insertion groove at a right angle even in a case where the bulb has to be attached to the housing in a way that the bulb is directed diagonally. Although it is difficult to hold the bulb at a right angle particularly in the case where the bulb is attached to the housing in a way that the bulb has to be directed diagonally, the 6th aspect of the present invention is capable of automatically placing the base of the bulb in a right position just by inserting the base thereof into the spacer by guess even if the base thereof is inserted into the spacer with no consideration being given to the angle of the base. Accordingly, the 6th aspect of the present invention is capable of enhancing the bulb attachment performance.

A 7th aspect dependent on the 6th aspect of the present invention is the bulb socket structure for the onboard interior lighting system according to the 6th aspect, in which an angle at which each guiding slope inclines corresponds to an angle at which an inclined part extending from the lower end of the bulb part to the base of the bulb inclines.

The 7th aspect of the present invention is capable of supporting the bulb more stably. That is because the 7th aspect of the present invention is capable of holding the inclined part extending from the lower end of the bulb part to the base of the bulb by causing the inclined part to abut on the guiding slopes.

An 8th aspect dependent on the first aspect of the present invention is the bulb socket structure for the onboard interior lighting system according to the first aspect, in which the spacer is formed of a resin material whose heat radiating performance is better than a material of the housing.

The 8th aspect of the present invention is capable of enhancing the heat resistance of the periphery of the bulb, and accordingly allows a brighter bulb with a larger heating value to be used for the bulb socket structure.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENT

Descriptions will be provided hereinbelow for the embodiment of the present invention by referring to FIGS. 3 to 9.

Figure 1:
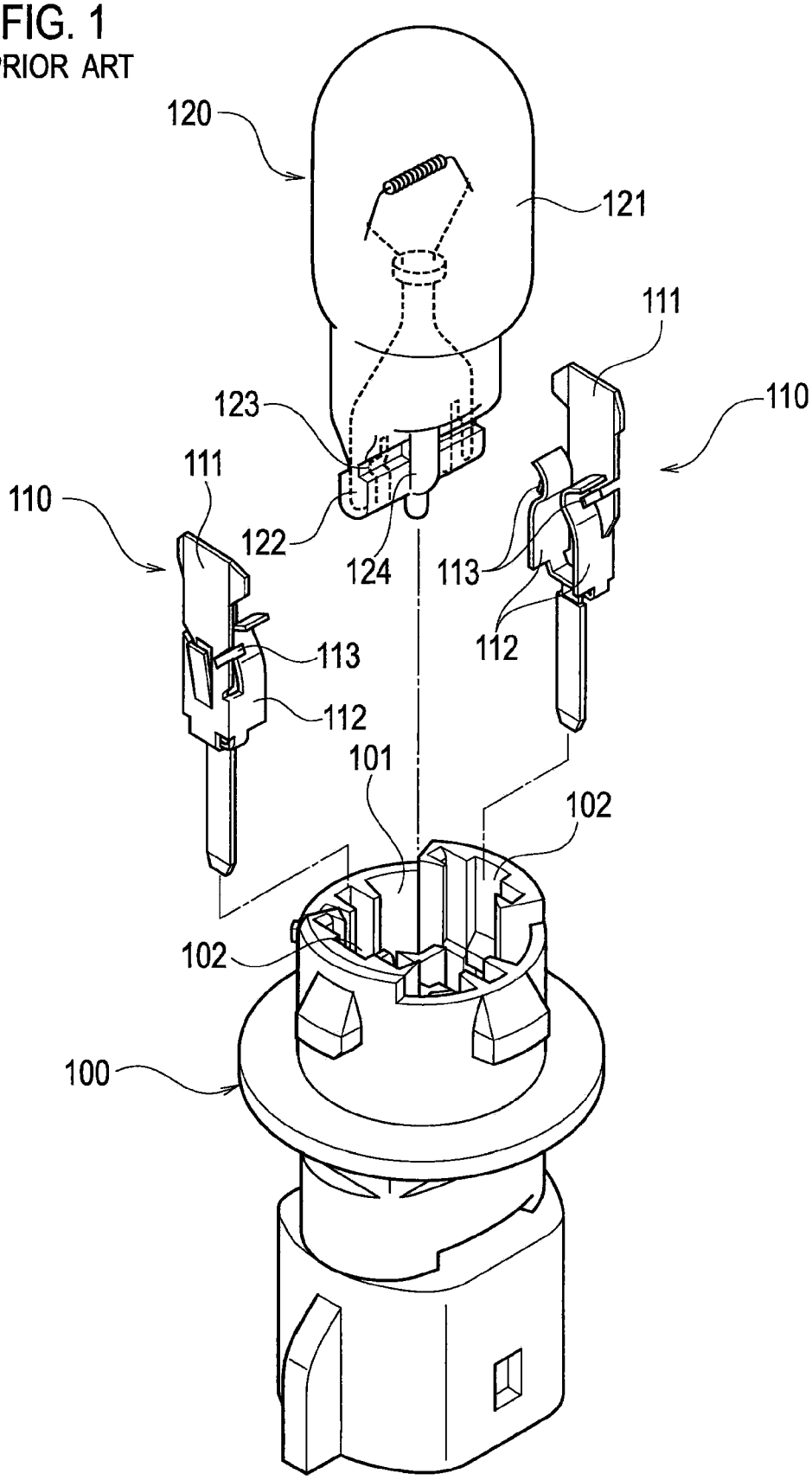
FIG. 1 PRIOR ART
FIG. 1 is an exploded, perspective view showing an example of a conventional model of bulb socket structure.
Figure 2:
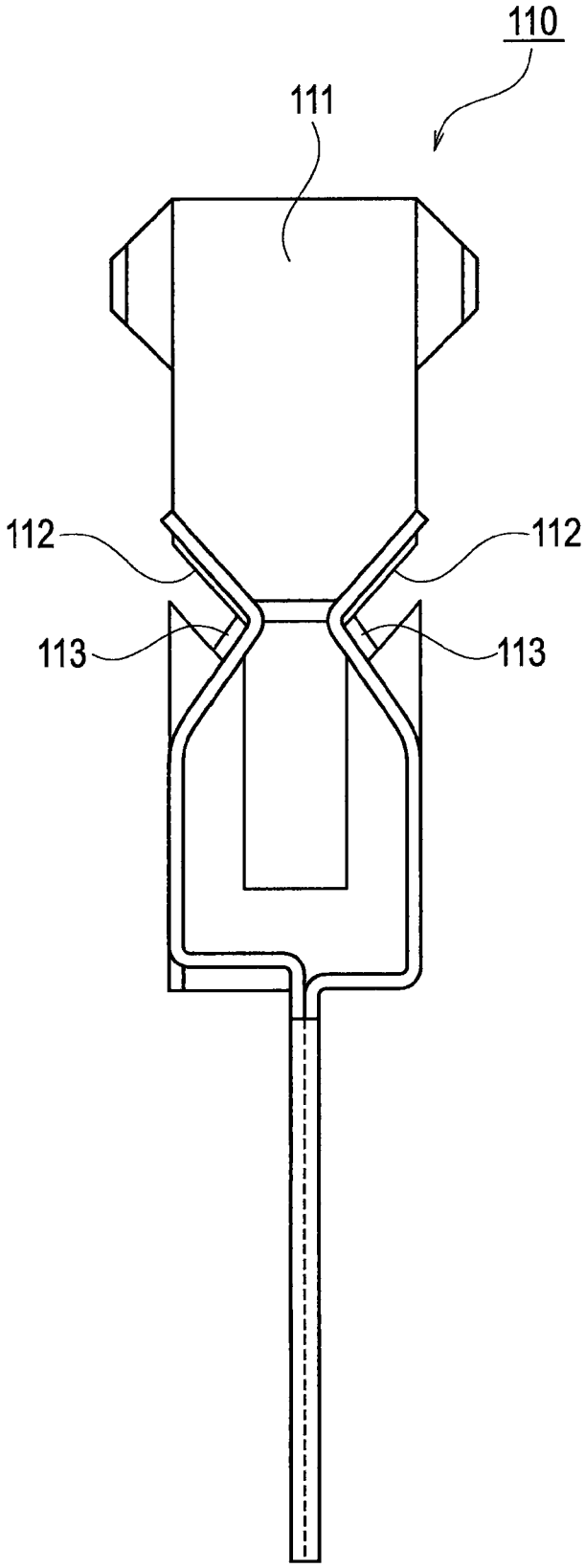
FIG. 2 PRIOR ART
FIG. 2 is a front view of a chief section of the conventional mode of bulb socket structure.
Figure 3:
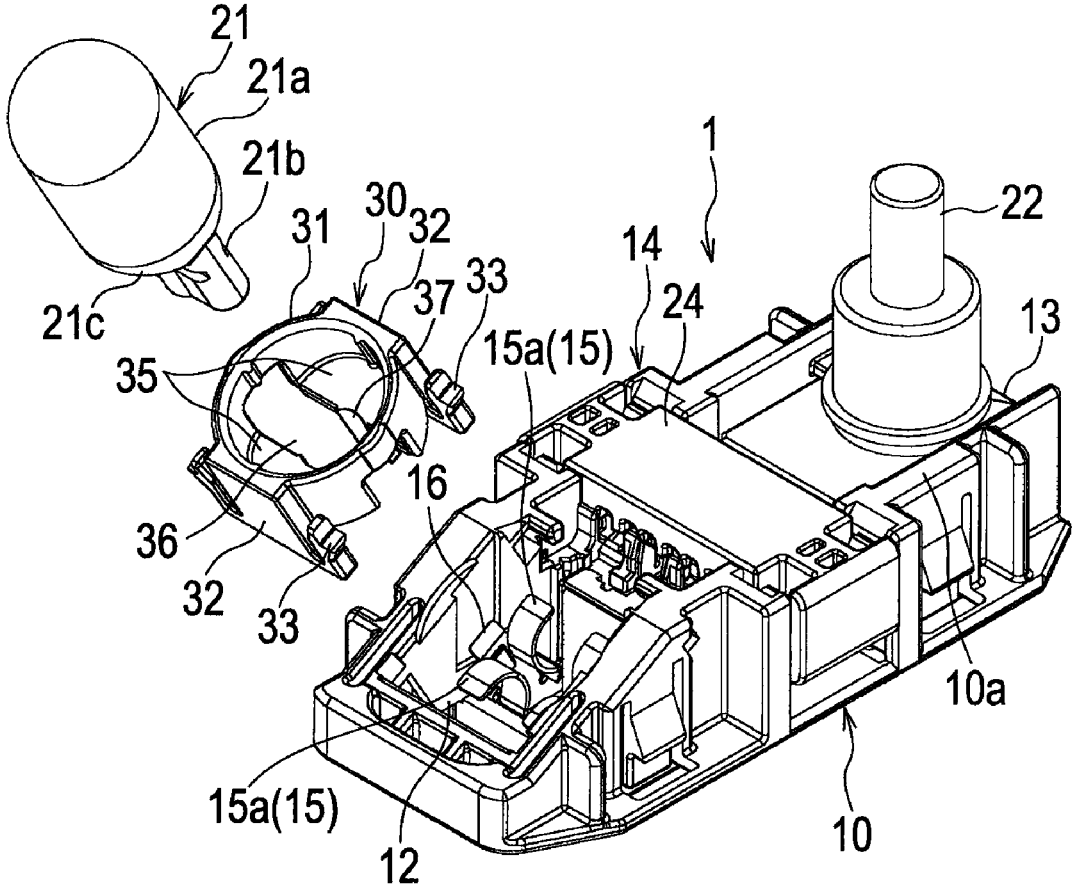
FIG. 3 is an exploded, perspective view showing a constitution of a functional section of an onboard interior lighting system including a bulb socket structure according to an embodiment of the present invention.

First of all, an onboard interior lighting system, to which a bulb socket structure according to the embodiment is applied, includes a functional section 1. The functional section 1 shown in FIG. 3 is provided to an exterior side of a ceiling board (a rear side of the ceiling) of a vehicle. This functional section 1 includes: a resin-made housing 10 serving as a functional section main body; a wedge base bulb 21 (hereinafter simply referred to as a "bulb") and a switch 22; an electric wire protecting cover 24. The housing 10 includes: an electric wire connector 14 to which the wires are connected; a bulb attachment (a bulb attachment hole 12) to which the bulb 21 as a light source is attached; and a switch attachment 13 to which the switch 22 is attached. The switch 22 is that with which to select one among modes of conducting electricity to the bulb 21. The bulb 21 is attached to the bulb attachment (the bulb attachment hole 12) of the housing 10, whereas the switch 22 is attached to the switch attachment 13 of the housing 10. The electric wire protecting cover 24 is configured to be attached to the electric wire connector 14 of the housing 10 after electric wires (whose illustrations are omitted from the drawings) are connected to the electric wire connector 14, and thus to protect the electric wires connected to the electric wire connector 14.

The bulb attachment hole 12 is provided in one end side of the housing 10 constituting the functional section. The bulb socket structure according to the present embodiment is applied to the bulb attachment hole 12. In this case, the bulb attachment hole 12 tilts to a base surface (a surface on which the designed section located on the interior side of the ceiling board and the functional section located on the exterior side of the ceiling board are attached to each other) 10*a* of the housing 10. The bulb 21 is designed to be attached to the bulb attachment (bulb attachment hole 12) in a way that the axis of the bulb 21 tilts to the base surface 10*a* of the housing 10.

Figure 6:
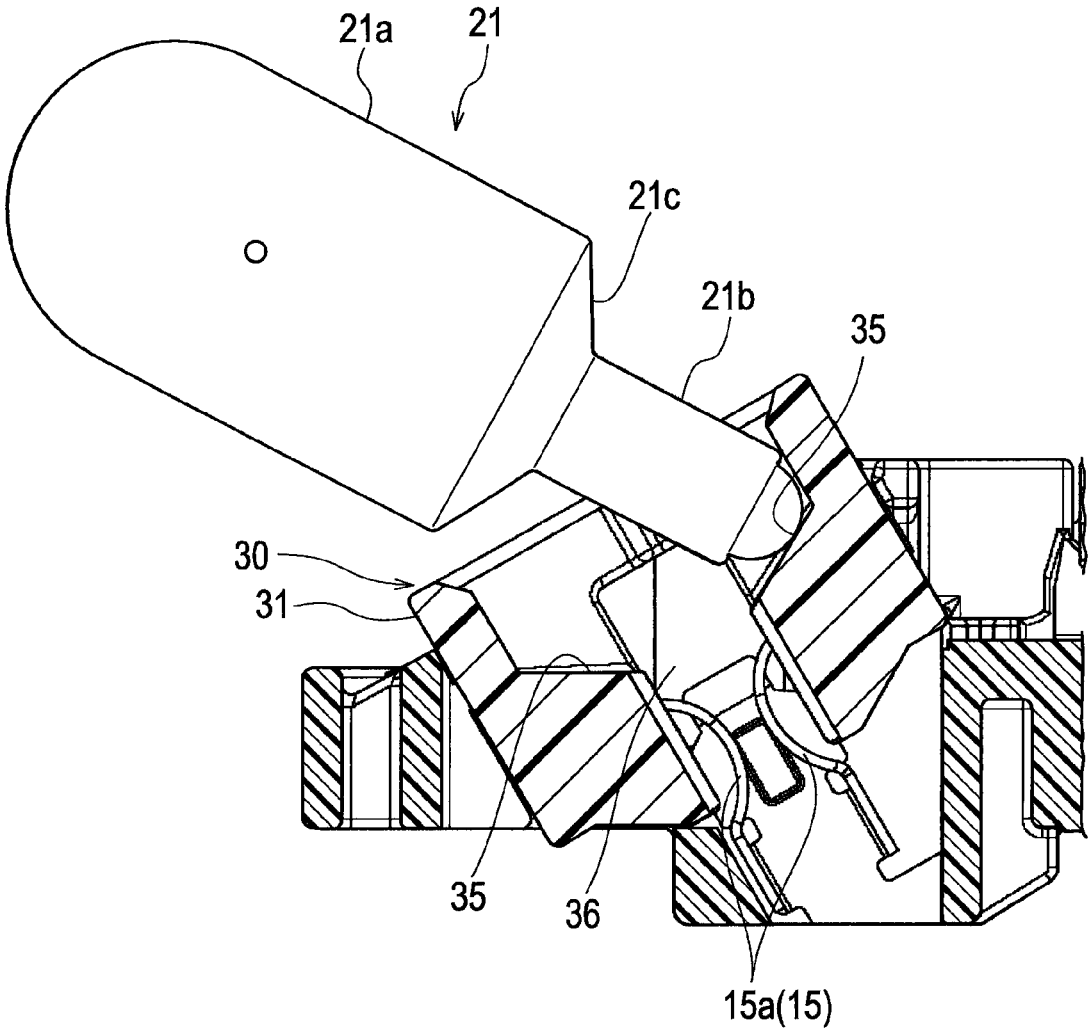
FIG. 6 is a cross-sectional view used for explaining an operation through which a wedge base bulb is attached to the bulb attachment hole to which the spacer is attached as shown in FIG. 5.

As shown in not only FIG. 3 but also FIG. 6, the bulb 21 has a flat base 21*b* under a cylinder-shaped bulb part 21*a* with an inclined part 21*c* interposed between the bulb part 21*a* and the base 21*b*. Terminals are provided to the base 21*b*. In addition, a columnar part (whose illustration is omitted from the drawings) is provided in a center portion of the base 21*b* in its width direction.

Figure 4:
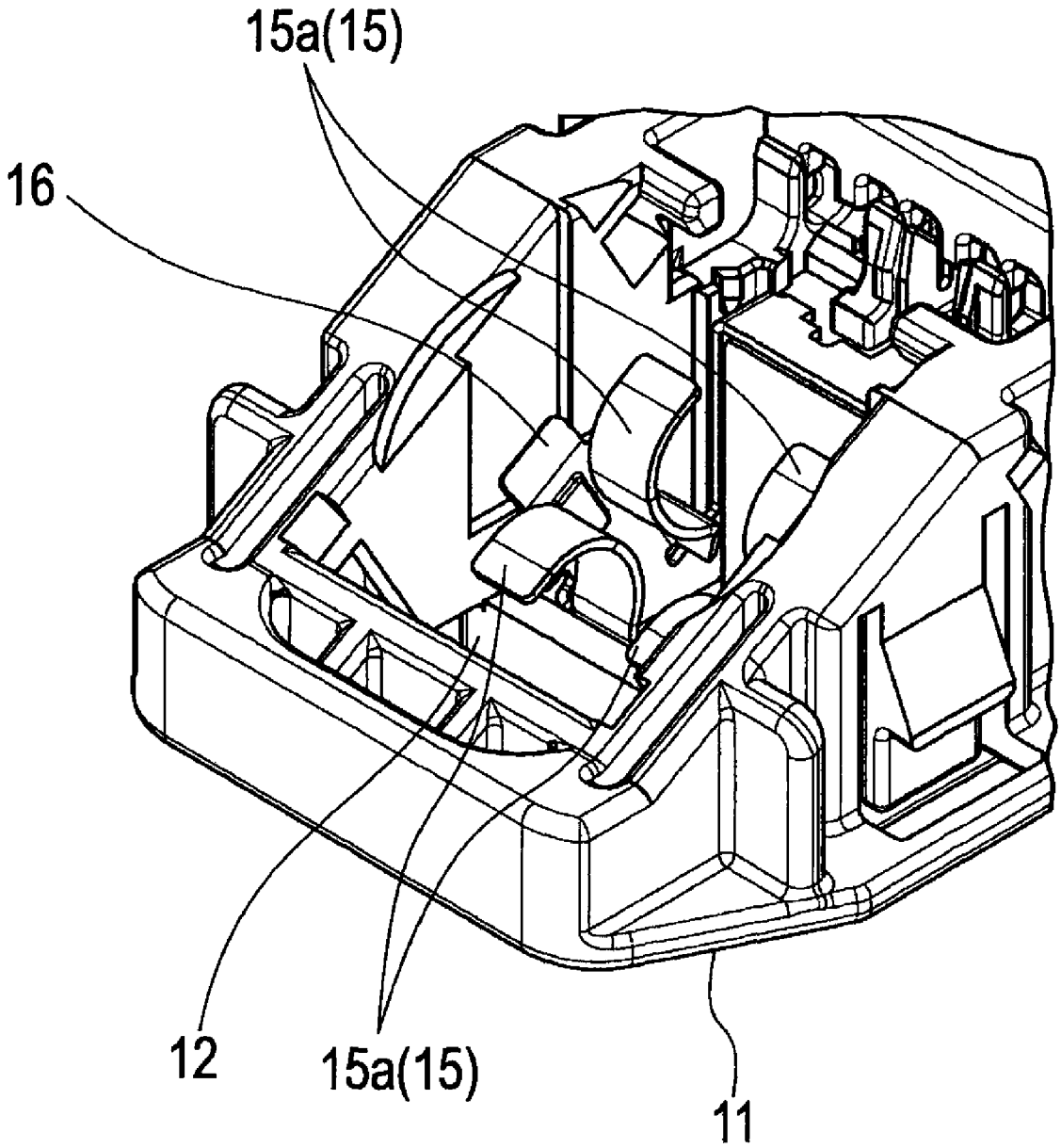
FIG. 4 is a perspective view showing an inner structure of a bulb attachment hole of the bulb socket structure in a magnified scale.

As shown in FIG. 4, paired power supply terminals 15, 15 are provided in the inside of the bulb attachment hole 12. The paired power supply terminals 15, 15 are configured to contact, and conduct electricity to, terminals of the base 21*b* when the base 21*b* of the bulb 21 is inserted into the inside of the bulb attachment hole 12. The paired power supply terminals 15, 15 are formed in bus bars which are included in different systems, respectively. Each power supply terminal 15 is provided with paired holding pieces 15*a*, 15*a* configured to hold the base 21*b* of the bulb 21 between the paired holding pieces 15*a*, 15*a*. The paired holding pieces 15*a*, 15*a* of each power supply terminal 15 are capable of deforming so as to expand an interstice between the paired holding pieces 15*a*, 15*a*.

Figure 5:
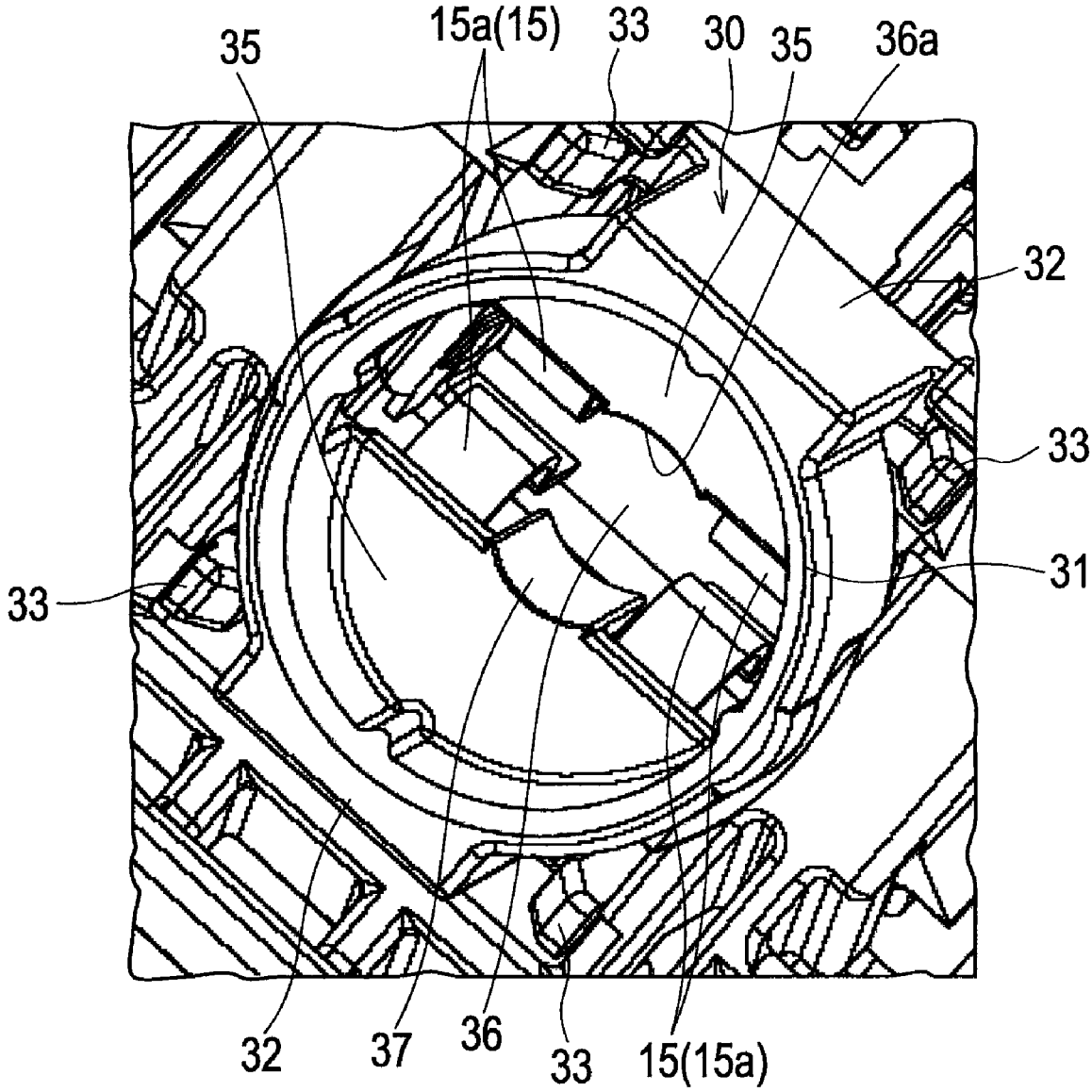
FIG. 5 is a perspective view showing how a spacer is attached to the bulb attachment hole.

Furthermore, as shown in FIG. 5, a resin-made spacer 30 is detachably attached to the inside of the bulb attachment hole 12. The spacer 30 includes a supporting cylindrical part 31 capable of supporting the bulb part 21*a* of the bulb 21 from its outer periphery. This spacer 30 is formed in a shape which allows the spacer 30 to bring the power supply terminals 15, 15 into contact with the respective terminals of the base 21*b* of the bulb 21 while protecting the power supply terminals 15, 15. This spacer 30 is fixed to the housing 10 by engaging four engaging claws 33, 33, 33, 33 with the respective four engaged parts (whose illustrations are omitted from the drawings). The four engaging claws are provided in the respective four locations in total, and the locations are the two sides of each of the two external walls 32 of the spacer 30. The four engaged parts are provided in the inside of the bulb attachment hole 12.

As shown in FIG. 6, guiding slopes 35, 35 configured to guide the base 21*b* of the bulb 21 to a right position in the inside of the bulb attachment hole 12 while the base 21*b* is being inserted into the inside of the bulb attachment hole 12 are provided in the inside of the supporting cylindrical part 31 of this spacer 30. As shown in FIG. 5, the paired guiding slopes 35, 35 are provided there in such a way as to be opposed to each other with an insertion groove 36 interposed in between, and in order to guide the base 21*b* to the insertion groove 36. As shown in FIG. 6, the paired guiding slopes 35, 35 are arranged on the upper and lower sides in a direction in which the axis of the bulb 21 tilts, respectively.

Figure 8:
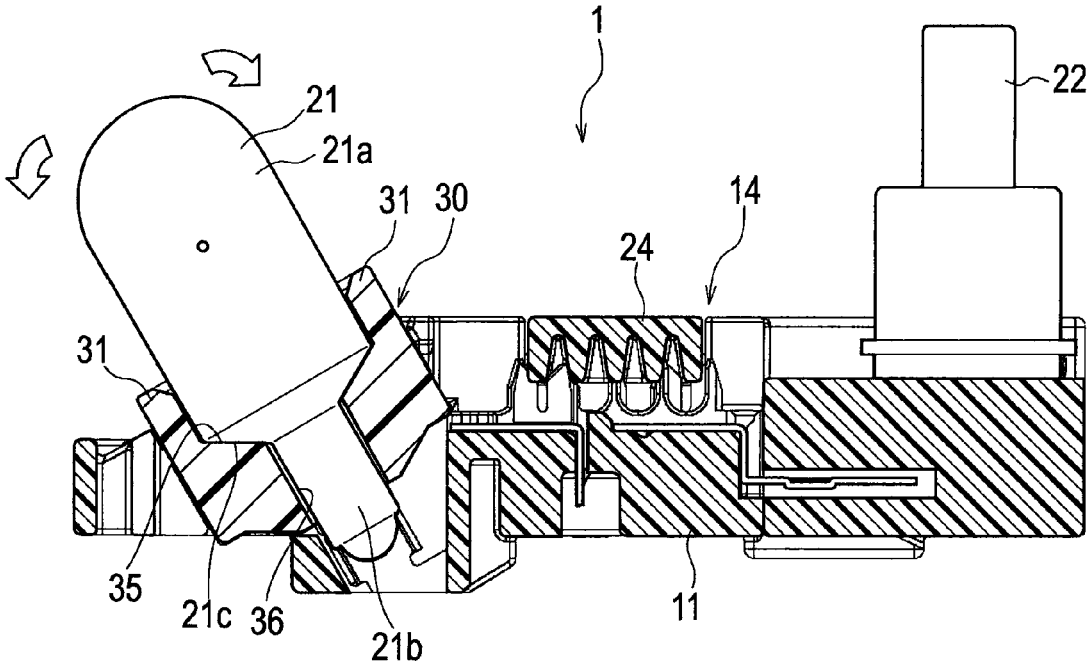
FIG. 8 is an auxiliary cross-sectional view of the functional section taken along the VIII-VIII line of FIG. 7.

Furthermore, as shown in FIG. 8, the angle at which each of the paired guiding slopes 35, 35 inclines corresponds to the angle at which the inclined part 21*c* extending from the lower end of the bulb part 21*a* to the base 21*b* of the bulb 21 inclines.

Moreover, as shown in FIG. 5, a columnar hole part 36*a* into which to insert a columnar part located in a center portion of the base 21*b* of the bulb 21 in the width direction of the base 21*b* is provided in a center portion of the insertion groove 36 in its width direction. Arcuate walls 37, 37 continuous with the lower ends of the guiding slopes 35, 35 are provided in the periphery of the columnar hole part 36*a*, respectively. In addition, bent parts are formed at the respective paired holding pieces 15*a*, 15*a* of each power supply terminal 15 so that the convex portions of the bent parts protrude into the insertion groove 36.

Next, descriptions will be provided for how the bulb socket structure for the onboard interior lighting system operates.

First of all, the spacer 30 is attached to the inside of the bulb attachment hole 12 of the housing 10, and is thus locked to the housing 10, before the bulb 21 is attached to the bulb attachment hole 12. Subsequently, the bulb 21 is inserted into the inside of the spacer 30 with the base 21 entering the inside of the spacer 30 first. At this time, the power supply terminals 15, 15 provided in the inside of the bulb attachment hole 12 are protected by the spacer 30. For this reason, the bulb socket structure according to the present embodiment is capable of avoiding deformation of the power supply terminals 15, 15 which would otherwise occur due to inadvertent collision of the base 21*b* of the bulb 21 against the power supply terminals 15, 15.

In addition, the paired guiding slopes 35, 35 are provided in the inside of the supporting cylindrical part 31 of the spacer 30, and the insertion groove 36 into which to insert the base 21*b* is formed in the interstice between the paired guide slopes 35, 35. For this reason, the bulb socket structure according to the present embodiment is capable of causing the guiding slopes 35, 35 to guide the base 21*b* of the bulb 21 to the insertion groove 36 without force, and of causing the base 21*b* to be held between the bent parts of the paired holding pieces 15*a*, 15*a* of each power supply terminal 15 which bent parts protrude into the insertion groove 36 once the base 21*b* is inserted into the insertion groove 36. Accordingly, the bulb socket structure according to the present embodiment is capable of causing the power supply terminals 15, 15 to contact, and conduct electricity to, the respective terminals of the base 21*b*.

Particularly in a case where, as shown in FIG. 6, the base 21*b* is inserted into the insertion groove 36 in a way that the base 21*b* is directed at an angle, or even in a case where the insertion groove 36 and the base 21*b* are not positioned to each other correctly, the bulb socket structure according to the embodiment is capable of causing the base 21*b* to be smoothly guided to the insertion groove 36 while correcting the orientation and position of the base 21*b* through the guiding function of the guiding slopes 35, 35. For this reason, the bulb socket structure according to the present embodiment is capable of smoothly attaching the base 21*b* of the base 21 to the interstice between the holding pieces 15*a*, 15*a* of each power supply terminal 15 without the power supply terminals 15, 15 being deformed by force, even if the bulb is inserted therein by touch.

Additionally, as shown in FIG. 5, the columnar hole part 36*a* into which to insert the column-shape part located in the center portion of the base 21*b* of the bulb 21 in the width direction of the base 21*b* is provided in the center portion of the insertion groove 36 in its width direction, and concurrently the arcuate walls 37, 37 continuous with the lower ends of the guiding slopes 35, 35 are provided in the periphery of the columnar hole part 36*a*, respectively. For this reason, the bulb socket structure according to the present embodiment is capable of causing the base 21*b* of the bulb 21 to be inserted in the interstice between the holding pieces 15*a*, 15*a* of each power supply terminal 15 with the base 21*b* thereof being securely positioned thereto in the width direction.

Although it is actually very difficult to hold the bulb 21 at a right angle particularly in a case where the bulb 21 is attached to the housing 10 in a way that the bulb 21 has to be directed diagonally, the bulb socket structure according to the present embodiment is capable of causing the upper and lower guiding slopes 35, 35 to guide the base 21*b* of the bulb 21 to the insertion groove 36 at a right angle so as to place the base 21*b* of the bulb 21 in a right position just by inserting the base 21*b* of the bulb 21 into the spacer 30 by guess even if the bulb 21*b* thereof is inserted into the spacer 30 with no consideration being given to the angle of the bulb 21. Consequently, the bulb socket structure according to the present embodiment is capable of enhancing the performance of attaching the bulb 21 to the housing 10.

Once the base 21*b* is inserted in the insertion groove 36 as described above, the base 21*b* is capable of being held between the paired holding pieces 15*a*, 15*a* of each power supply terminal 15. For this reason, the bulb socket structure according to the present embodiment is capable of holding the bulb 21 in a way that the bulb 21 is not loose or shaky, and thus of securely causing the power supply terminals 15, 15 to contact, and conduct electricity to, the respective terminals of the base 21*b*.

Figure 7:
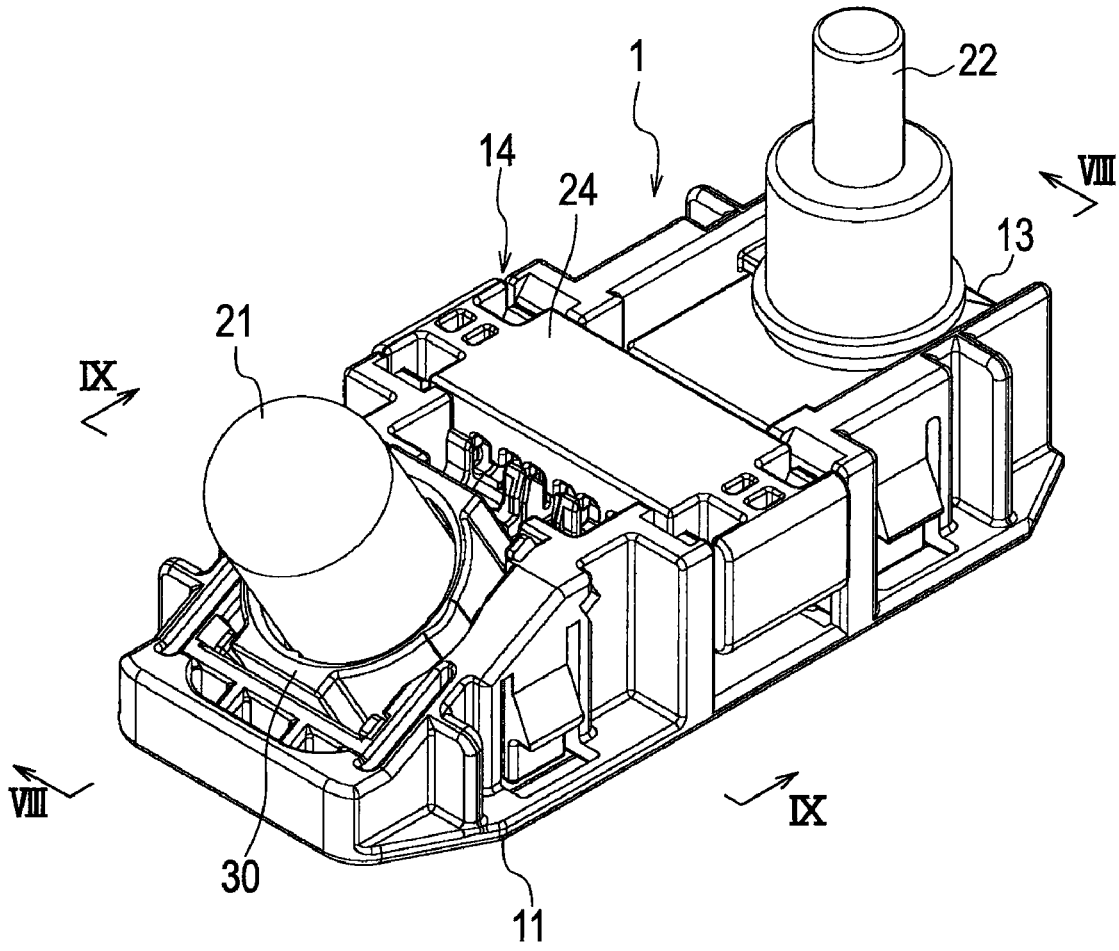
FIG. 7 is an external, perspective view showing a constitution of the functional section to which the wedge base bulb is attached.
Figure 9:
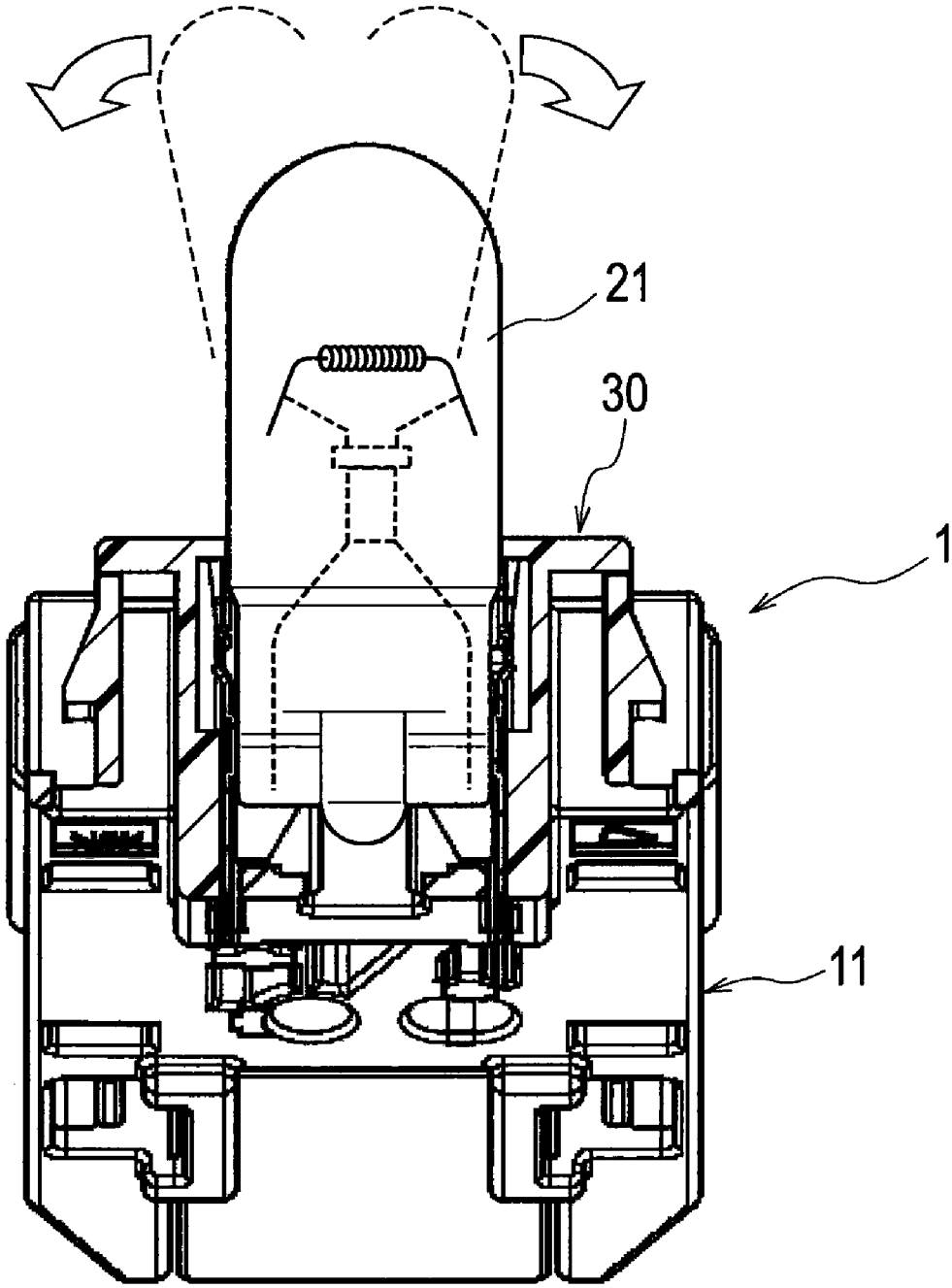
FIG. 9 is an auxiliary cross-sectional view of the functional section taken along the IX-IX line of FIG. 7.

Moreover, as shown in FIGS. 7 to 9, the supporting cylindrical part 31 of the spacer 30 supports the bulb part 21*a* of the bulb 20 from its outer periphery while the bulb 21 is being attached to the bulb attachment hole 12. For this reason, the bulb socket structure according to the present embodiment is capable of checking the bulb 21 from being loose and shaky in all the directions, of preventing the power supply terminals 15, 15 from contacting the terminals of the bulb 21 in a wrong condition, and accordingly of enhancing the reliability, even if an external force is applied to the bulb 21.

In addition, the inclined part 21*c* extending from the lower end of the bulb part 21*a* to the base 21*b* of the bulb 21 abuts on the guiding slopes 35, 35. For this reason, the bulb socket structure according to the present embodiment is capable of supporting the bulb 21 stably.

Additionally, as in this embodiment, the spacer 30 produced independently of the housing 10 is attached to the housing 10. For this reason, the bulb socket structure according to the present embodiment can prevent forced deformation of the power supply terminals 15, 15 which would otherwise occur. Accordingly, the bulb socket structure according to present embodiment makes it unnecessary that an element having a function for protecting the power supply terminals 15, 15 from the forced deformation should be additionally included in the housing 10, and is accordingly capable of avoiding the housing 10 having a complicated configuration. Furthermore, the spacer 30 is detachably attached to the housing 10. For this reason, the bulb socket structure according to the present embodiment makes it possible to replace one spacer 30 with another freely.

Note that, in a case where the spacer 30 is formed of a resin material whose heat radiating performance is better than a material of the housing 10, it is possible to enhance the heat resistance of the periphery of the bulb 21. Accordingly, the use of such a resin material enables a brighter bulb with a larger heating value to be used for the bulb socket structure.

The present invention is not limited to the above-description and the above-described embodiments, and may be embodied in various different forms by making appropriate modifications thereto.

It should be noted that the entire content of Japanese Patent Application No. 2008-013926 (filed on Jan. 24, 2008) is incorporated herein by reference.

What is claimed is:

1. A bulb socket structure for an onboard interior lighting system, comprising:

a resin-made housing constituting the onboard interior lighting system;

a bulb attachment hole formed in the housing, the bulb attachment hole being attachable with a wedge base bulb;

power supply terminals configured to contact with and conduct electricity to terminals provided at a base of the wedge base bulb when the base is inserted into the bulb attachment hole, the base being located at a lower portion of the wedge base bulb the power supply terminals being provided inside the bulb attachment hole; and a spacer configured to be attached to the bulb attachment hole, the spacer being a single integral component, the spacer including a supporting cylindrical part capable of supporting the bulb part of the wedge base bulb from its outer periphery, and the spacer being capable of causing the terminals of the base of the wedge base bulb to contact the respective power supply terminals while protecting the power supply terminals.

2. The bulb socket structure for the onboard interior lighting system according to claim 1, wherein the spacer is detachably attached to the inside of the bulb attachment hole; and fixing means are provided to both ends of the spacer and the housing wherein the fixing means are configured to lock the spacer with the housing when the spacer is attached to the inside of the bulb attachment hole.

3. The bulb socket structure for the onboard interior lighting system according to claim 1, wherein a guiding slope is provided inside the supporting cylindrical part wherein the guiding slope is configured to guide the base of the wedge base bulb to a right position inside the bulb attachment hole when the base of the wedge base bulb is inserted into the supporting cylindrical part.

4. The bulb socket structure for the onboard interior lighting system according to claim 1, wherein the power supply terminals include two power supply terminals each including paired holding pieces configured to hold the base of the wedge base bulb between the paired holding pieces;

an insertion groove configured to receive the base of the wedge base bulb is formed in the spacer; and the bulb socket structure further includes:

a pair of guiding slopes located so as to be opposed to each other relative to the insertion groove, the insertion groove being interposed between the pair of the guiding slopes to guide the base toward the insertion groove; and bent parts formed at the respective paired holding pieces of each power supply terminal so that convex portions of the bent parts respectively protrude into the insertion groove.

5. The bulb socket structure for the onboard interior lighting system according to claim 4, wherein a columnar hole part configured to receive a columnar part located in a center portion of the base of the wedge base bulb in the width direction of the base is provided in a center portion of the insertion groove in its width direction; and arcuate walls continuous with and protruding from the lower ends of the guiding slopes are provided on the periphery of the columnar hole part, respectively.

6. The bulb socket structure for the onboard interior lighting system according to claim 4, wherein a direction in which an axis of the wedge base bulb extends to the housing tilts to a base surface of the housing; and the pair of guiding slopes are arranged on the upper and lower sides in a direction in which the axis of the bulb tilts, respectively.

7. The bulb socket structure for the onboard interior lighting system according to claim 6, wherein an angle at which each guiding slope inclines corresponds to an angle at which an inclined part extending from the lower end of the bulb part to the base of the wedge base bulb inclines.

8. The bulb socket structure for the onboard interior lighting system according to claim 1, wherein the spacer is formed of a resin material whose heat radiating performance is better than a material of the housing.

9. The bulb socket structure for the onboard interior lighting system according to claim 1, wherein the spacer completely encircles a periphery of a bulb part of the wedge base bulb.

10. The bulb socket structure for the onboard interior lighting system according to claim 5, wherein the arcuate walls extend in a length direction of the wedge base bulb an amount about equal to a length of the columnar part of the base.

* * * * *

UNITED STATES PATENT AND TRADEMARK OFFICE

CERTIFICATE OF CORRECTION

PATENT NO. : 7,717,746 B2
APPLICATION NO. : 12/353572
DATED : May 18, 2010
INVENTOR(S) : Kentaro Nagai et al.

It is certified that error appears in the above-identified patent and that said Letters Patent is hereby corrected as shown below:

On the Title Page, Item (57), Abstract: line 11, "spacer is includes" should read --spacer includes--.

*In claim 1, column 9, line 44, "base bulb the power" should read --base bulb, the power--.

Signed and Sealed this

Tenth Day of August, 2010

David J. Kappos

David J. Kappos
*Director of the United States Patent and Trademark Office*